United States Patent [19]

Ueda et al.

[11] Patent Number: 4,952,978

[45] Date of Patent: Aug. 28, 1990

[54] SPEED CONTROL OF COLOR DEVELOPMENT IN ELECTROPHOTOGRAPHIC PROCESS AND APPARATUS

[75] Inventors: Shigenori Ueda, Kawasaki; Koji Yamazaki, Ebina; Toshiyuki Ehara; Nobuyuki Kume, both of Yokohama; Nobuo Nakazawa, Kawasaki, all of Japan

[73] Assignee: Canon Kabushiki Kaisha, Tokyo, Japan

[21] Appl. No.: 376,439

[22] Filed: Jul. 7, 1989

[30] Foreign Application Priority Data

Jul. 11, 1988 [JP] Japan ..... 63-170835
Sep. 30, 1988 [JP] Japan ..... 63-248419

[51] Int. Cl.[5] ..... G03G 15/08

[52] U.S. Cl. ..... 355/245; 355/210; 355/326; 430/120

[58] Field of Search ..... 355/210, 245, 326; 430/120, 357

[56] References Cited

U.S. PATENT DOCUMENTS

| | | | |
|---|---|---|---|
| 4,615,612 | 10/1986 | Ohno et al. | 355/326 X |
| 4,816,869 | 3/1989 | Kasai et al. | 355/326 X |
| 4,841,336 | 6/1989 | Kusumoto et al. | 355/245 |
| 4,860,048 | 8/1989 | Itoh et al. | 355/326 X |
| 4,860,053 | 8/1989 | Yamamoto et al. | 355/245 |

*Primary Examiner*—A. C. Prescott

*Attorney, Agent, or Firm*—Fitzpatrick, Cella, Harper & Scinto

[57] ABSTRACT

An electrophotographic process using a photosensitive member having an amorphous silicon photosensitive layer, includes uniformly charging the photosensitive member, and exposing the photosensitive member to information light to form an electrostatic latent image, developing the electrostatic latent image using a developing device selected from a plurality of developing devices disposed along a movement direction of the photosensitive member, wherein a movement speed of the photosensitive member is lower when a selected developing device is the one closer to the station where the uniformly charging step is performed than when another developing device is selected, whereby the time periods for a portion of the photosensitive member to move from the charging station to the developing devices is substantially constant.

15 Claims, 3 Drawing Sheets

FIG. 3B
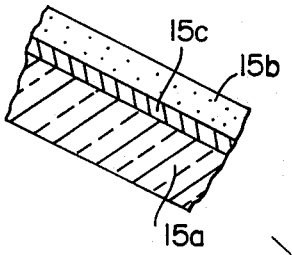
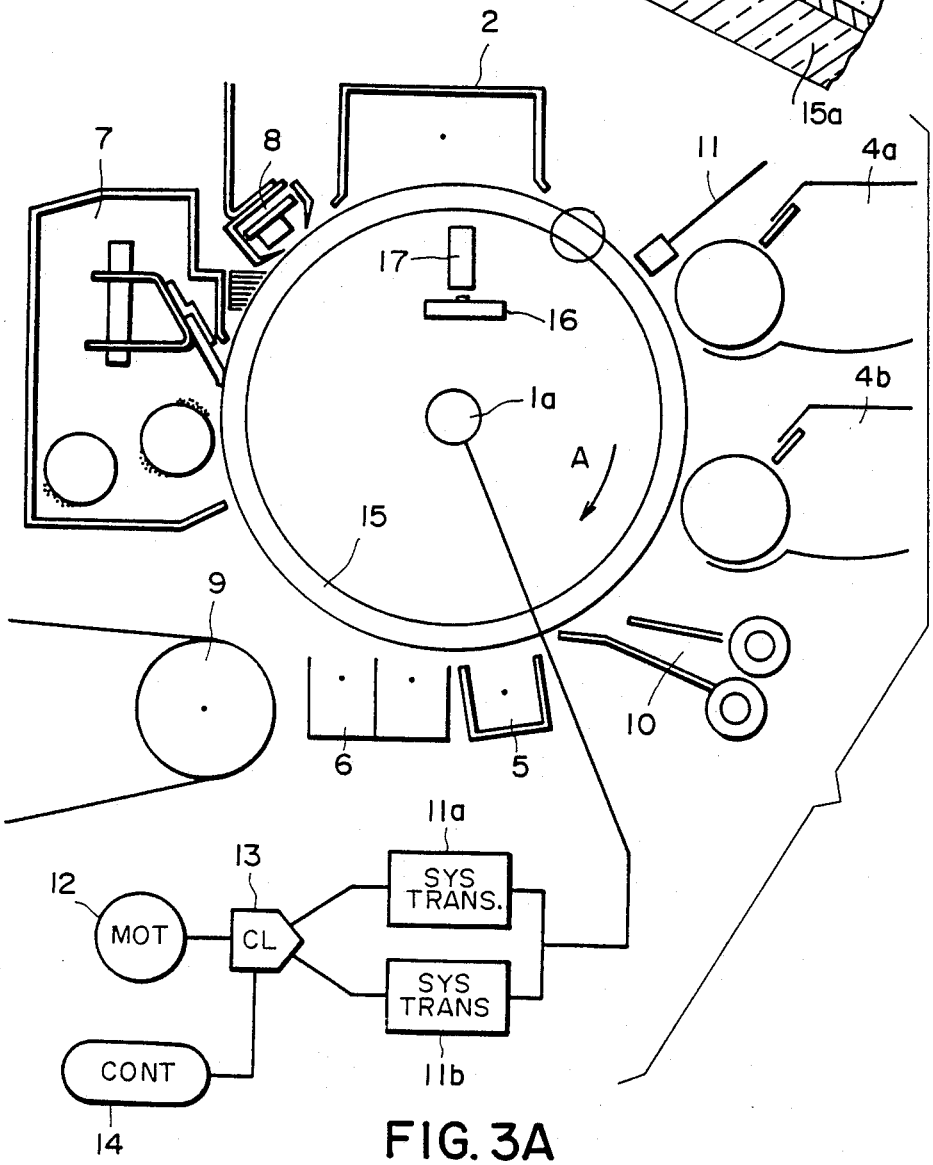
FIG. 3A

SPEED CONTROL OF COLOR DEVELOPMENT IN ELECTROPHOTOGRAPHIC PROCESS AND APPARATUS

FIELD OF THE INVENTION AND RELATED ART

The present invention relates to electrophotographic process and apparatus usable in an electrophotographic copying machine.

In such an electrophotographic apparatus, an electrophotographic photosensitive drum used as a latent image bearing member is made of, amorphous silicon, on which latent two or more latent images are formed and are developed into visualized images with two or more developing devices disposed around the photosensitive drum. The visualized image or images are transferred onto a transfer material conveyed by a transfer material conveying device, thus forming an image on the transfer material.

The present invention is applicable not only to the electrophotographic copying machine, but also to various printers used as terminal devices for information processing machines such as a computer, a facsimile machine and CAD. In the present specification, a laser beam printer using the electrophotographic process is taken as an exemplary apparatus.

Recently, a laser beam printer is widely used wherein images are formed through an electrophotographic process, for example. The laser beam printer has various advantages in the high quality of the images, high processing speed and low noise. It is a recent demand that the images can be formed in a color or colors other than black, such as red and blue, in addition to the monochromatic black image. In an image forming apparatus capable of forming an image in plural colors, ordinarily one photosensitive drum (image bearing member) is provided to carry a latent image formed through a predetermined process. Around the photosensitive drum, at least two developing devices are disposed to develop the latent images in different colors. For example, it is known that the image forming apparatus (copying machine) includes two developing devices, for example, a black developing device containing a black developer and a red developing device containing a red developer. In such a copying machine, the developing devices can provide the image in two colors, black and red. As a result, a graph and a table can be more illustratively printed, which is very convenient to the users.

On the other hand, an amorphous silicon photosensitive drum is advantageous in a high surface hardness, a high photosensitivity to a long wavelength light provided, for example, by a semiconductor laser (770 nm–800 nm), and in hardly any deterioration despite repeated use thereof. Therefore, it is particularly used as an electrophotographic photosensitive member in a high speed copying machine and a laser printer.

However, the amorphous silicon photosensitive drum involves many dangling bonds, and has many localized energy level portions and has a large dark decay. Therefore, when two developing devices are disposed different distances from a sensitizing charger, the surface potentials at the developing positions are different, with the result that the image qualities provided by the first developing device and the second developing device are different. The amount of dark decay is dependent also upon the temperature of the photosensitive drum, the wave length and the strength of the pre-exposure light. Therefore, the image forming apparatus using the amorphous silicon photosensitive drum is generally provided with a drum heater capable of finely controlling the temperature or pre-exposure means such as an array of LED elements.

When, for example, an amorphous silicon photosensitive drum having a coated amorphous silicon layer having a film thickness of 30 microns, is uniformly charged, a dark portion potential at the position of the first developing device closer to the charger is 480 V, whereas that at the second developing device more remote from the charger than the first developing device is 400 V. There is a difference of 60–80 V between the different developing devices, with the result of the difference in the image qualities. In order to provide an image density higher than a predetermined level in the resultant image, the amount of charge applied to the photosensitive member has to be determined on the basis of the dark portion potential at the second developing device where the dark portion potential is lower. This, however, results in the dark portion potential which is higher than necessary, at the first developing device. Therefore, the amount of charge is larger than necessary at the first developing device, and the developer or toner consumption there becomes larger than necessary.

It is conventional that a potential of the latent image on the photosensitive drum is measured using a potential sensor, and in response to the measurement, (1) variation in the latent image potential attributable to the change in the charging power of the charger due to the ambient condition variation, contamination of the wire of the charger and the contamination of the optical system is corrected to assure the stabilized image quality, and (2) the original is exposed to a predetermined amount of light to provide an optimum exposure amount, and the amount is automatically set. By doing so, it is possible that a high stability can be provided in combination with use of an amorphous silicon photosensitive drum having highly stabilized properties.

However, as described hereinbefore, in the arrangement wherein two developing devices are disposed around a photosensitive drum, use of the amorphous silicon drum as the photosensitive drum results in a large potential difference such as approximately 60–80 V between the potentials at the first developing device and the second developing device. When the proper potential is set on the basis of the second developing device, the potential is too high at the first developing device with the result of production of foggy background.

Japanese Laid-Open Patent Applications Nos. 20962/1986 and 120175/1986 disclose that the main or primary charging power is controlled to provide the same potential at the first developing device and at the second developing device. In order to effect the control, a potential control system has to be provided to increase the output of the charger when the second developing device is selected than when the first developing device is selected. In addition, a chromatic developer such as a red developer is usually non-magnetic, and therefore, the toner is more easily scattered with increase of the rotational speed of the photosensitive drum. This promotes contamination of the optical system and the charger or the like with the result of deterioration of the image. In addition, the cleaning device has to be reconsidered to provide good cleaning properties both for the magnetic and nonmagnetic developers.

SUMMARY OF THE INVENTION

Accordingly, it is a principal object of the present invention to provide an image forming apparatus or process wherein an electrophotographic photosensitive member such as an amorphous silicon photosensitive member, which has a property relatively quickly changing with time, is used with a plurality of developing devices for developing latent images thereon, the developing devices being disposed in series in the direction of the photosensitive member surface movement wherein good images can be provided.

According to one aspect of the present invention, there is provided an electrophotographic process using an amorphous silicon photosensitive member, comprising uniformly charging the photosensitive member, simultaneously or sequentially forming an electrostatic latent image on the photosensitive member, developing the latent image thus formed with a selected one of the developing devices which are disposed in the direction of the photosensitive member movement, wherein the movement speed of the photosensitive member is reduced when one of the developing devices which is closer to the station for performing the uniformly charging step is selected than when the remote one is selected, whereby the time periods required for a portion of the photosensitive member to moves from the uniformly charging station to the selected developing devices are made substantially the same.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3A is a sectional view of an image forming apparatus according to another embodiment of the present invention.

FIG. 3B is a sectional view showing the layers of the photosensitive drum.

DETAILED DESCRIPTION OF THE PREFERRED EMBODIMENT

Figure 1:
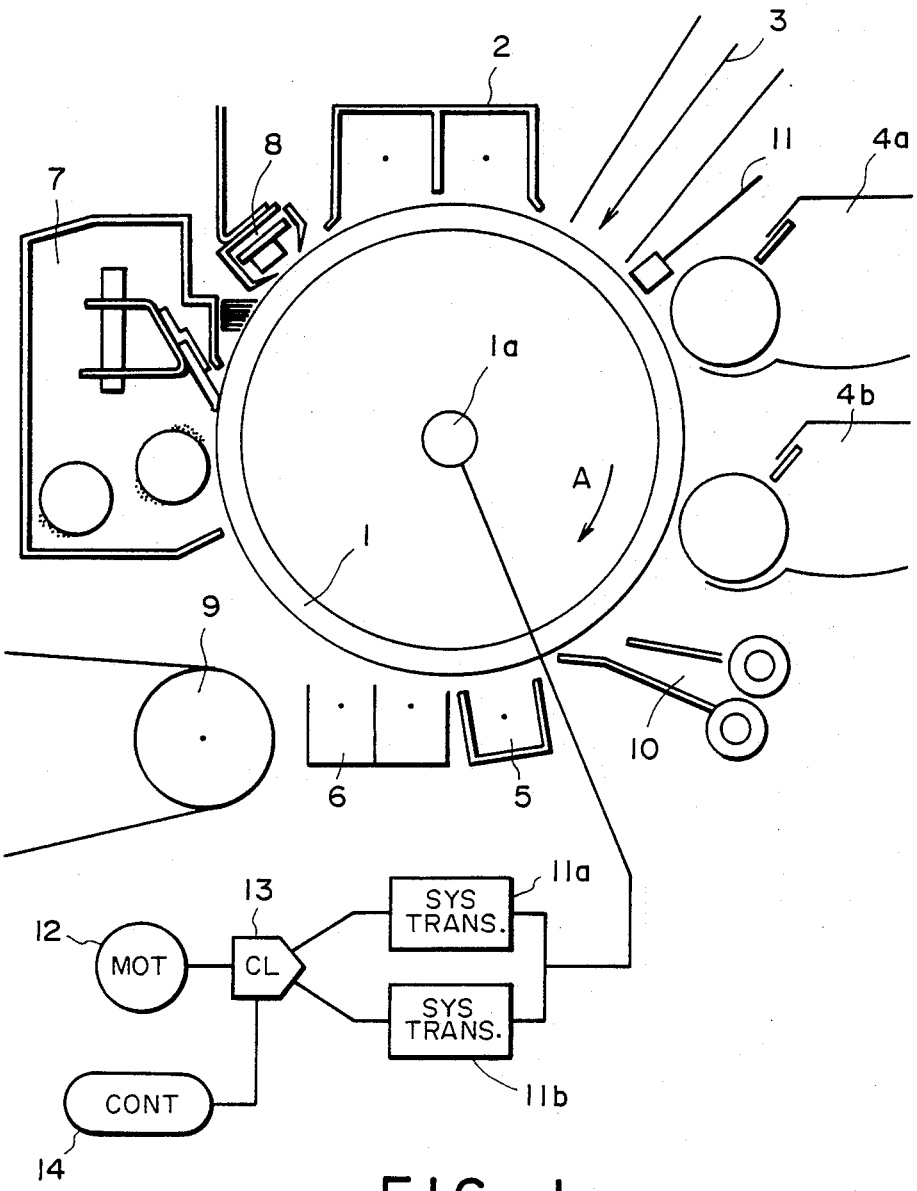
FIG. 1 is a sectional view of an image forming apparatus using a photosensitive drum made of amorphous silicon, according to an embodiment of the present invention.

Referring to FIG. 1, there is shown an image forming apparatus provided with two developing devices as an exemplary image forming apparatus according to the present invention. The image forming apparatus is capable of forming a two-color image and includes one amorphous silicon photosensitive drum having a photoconductive layer mainly consisting of amorphous silicon, as the photosensitive member. The amorphous silicon photosensitive drum 1 is in the form of a cylinder having a diameter of approximately 180 mm and is rotatable in the direction indicated by an arrow. Around the photosensitive drum 1, there are disposed a primary charger 2, a latent image forming means 3, a surface potential sensor 11, a first developing device **4*a* containing a red developer, a second developing device 4*b* containing a black developer, a transfer material feeding roller 10, a transfer charger 5, a separation charger 6, a cleaner 7 and a discharging exposure device 8, in the order named along the rotational direction of the photosensitive drum 1**.

With this structure, the charging, image exposure, developing and image transfer steps are performed through an electrophotographic process. More particularly, the surface of the photosensitive drum 1 is uniformly charged by the primary charger 2, and is disposed to image light by the latent image forming means 3 so that a latent image in accordance with original information is formed on the photosensitive drum 1. The latent image is developed with a selected one **4*a* of the developing devices. Then, a second latent image is formed through the same process, and is then developed with the other developing device 4*b*. The developed images are transferred together by the transfer charger 5 onto the transfer material supplied by the transfer material feeding roller 10. The transfer material now having the visualized image is separated from the photosensitive drum by the separation charger 6**.

The separated transfer material is conveyed by a transfer material conveying device 9 disposed downstream of the separation charger 6 to an unshown fixing device where the visualized image is fixed on the transfer material into a permanent image.

On the other hand, the developer remaining on the photosensitive drum 1 after the step of the image transfer from the photosensitive drum 1 to the transfer material, is removed from the photosensitive drum 1 by the cleaning device 7, so that it is prepared for the next image forming process.

Figure 2A:
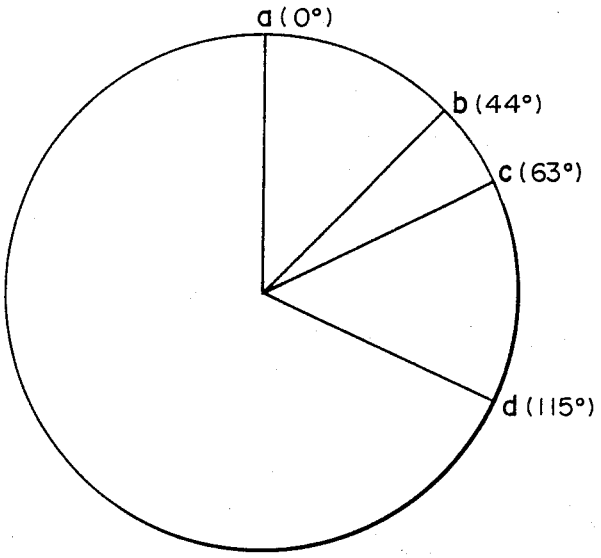
FIG. 2A shows positional relations among a main or primary charger, a surface potential sensor for measuring the surface potential of the amorphous silicon photosensitive drum, a first developing device and a second developing device, disposed around the photosensitive drum.
Figure 2B:
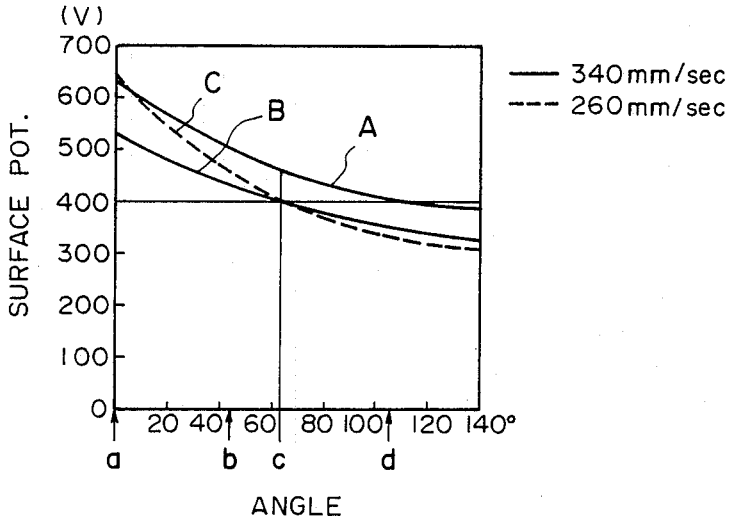
FIG. 2B shows potential attenuation of the amorphous silicon photosensitive drum when it is rotated, when the primary charger, the surface potential sensor, the first developing device and the second developing device are disposed in the manner shown in FIG. 2A.

Referring to FIGS. 2A and 2B, the image forming process will be described in more detail.

Referring first to FIG. 2A, there is shown positional relations among the primary charger 2, the surface potential sensor 11, the first developing device **4*a* and the second developing device 4*b* in the apparatus of FIG. 1. The surface potential sensor 11 is separated from the primary charger 2 by 44 degrees, and the first developing device 4*a* and the second developing device 4*b*** are seprated therefrom by 63 degrees and 115 degrees, respectively.

FIG. 2B shows the potential attenuation on the surface of the photosensitive drum 1 in the positional relations among the primary charger 2, the surface potential sensor 11, the first developing device **4*a* and the second developing device 4*b* shown in FIG. 2A, more particularly, it is a graph of the surface potential measured by the sensor 11 vs. the positions (angles) of the devices when the photosensitive drum 1** is rotated.

In FIG. 2B, a curve A represents a dark decay curve of the amorphous silicon photosensitive drum when the peripheral speed of the photosensitive drum 1 in the direction A in FIG. 1 is 340 mm/sec and when the drum 1 is charged to provide 400 V at the position of the second developing device, and a curve B represents the dark decay curve with the same peripheral speed when the surface potential at the position of the first developing device is controlled to be 400 V by a conventional control system. A curve C represents the dark decay curve when the peripheral speed is controlled to be 260 mm/sec to provide the 400 V at the position of the first developing device according to the present invention. According to the present invention, the rotational speeds (peripheral speeds) to the developing devices for developing the latent images formed through the latent image forming process using the primary charger are made different.

By this, the dark decay until the uniformly charged portion of the photosensitive drum reaches each of the developing devices can be made equivalent, so that the dark portion potentials can be made substantially the same at the respective developing devices. The time required for a portion of the photosensitive drum charged by the primary charger to reach a developing device is the same whichever developing device is selected, by changing the movement speed of the photosensitive drum.

Referring back to FIG. 1, the mechanism for changing the speed will be described. A rotational shaft 1*a* of the photosensitive drum 1 is selectively connectable with driving systems 11*a* and 11*b* which have different gear ratios. A motor 12 for driving the photosensitive drum 1 is connectable selectively with the driving systems 11*a* and 11*b* through a clutch 13 for selectively switching the drive transmission systems. In association with the selection of the developing devices 4*a* and 4*b*, the clutch 13 is operated by a control system 14 to transmit the driving force from the motor 12 selectively through the driving systems 11*a* and 11*b*.

In the foregoing description of the embodiment, the photosensitive member is in the form of a drum, but it may be in the form of a belt.

EXPERIMENT 1

The image forming apparatus had the structure shown in FIG. 1, wherein the photosensitive drum comprised an aluminum cylinder having a diameter of approximately 108 mm and an amorphous silicon photosensitive layer having a thickness of approximately 30 microns. On such a photosensitive drum, a latent image was formed through the process described hereinbefore and was developed. In order to provide a multi-color visualized image, the first and second developing devices were used. When the second developing device (black) was used, the peripheral speed of the photosensitive drum 1 was 340 mm/sec in the direction of the arrow A (FIG. 1), and when the first developing device (color toner, more particularly, red toner) was used, the peripheral speed of the photosensitive drum was 260 mm/sec. The image forming processes were performed continuously for 10,000 sheets, and it was confirmed that the image qualities were high without foggy background, scattered toners and other image defects.

The color toner is easily scattered when the peripheral speed of the photosensitive drum is increased, and therefore, it is advantageous that the peripheral speed is decreased when the color toner developing device (first developing device) is used. In the ordinary use, the frequency of the color toner (red) use is only approximately 2 % of the frequency of the use of the black developer, and therefore, the overall copy producing speed is not adversely affected, in effect, by the reduction of the rotational speed of the photosensitive drum when the first developing device (red) is used.

EXPERIMENT 2 (COMPARISON EXPERIMENT)

The photosensitive drum 1 used in the experiment 1 was rotated at a constant speed of 340 mm/sec, and the primary charger current was controlled to provide 400 V of the dark portion potential at the position of the second developing device. The other conditions were the same as in the experiment 1. The red image developed by the first developing device had a foggy background, and the non-magnetic toner was scattered because the rotational speed of the photosensitive drum 1 was high (340 mm/sec). It was not possible to provide good images for a long period.

EXPERIMENT 3 (COMPARISON EXPERIMENT)

The first developing device and the second developing device were exchanged, and the same experiments as in Experiment 1 were performed. The red toner of the second developing device was scattered because the rotational speed is high (340 mm/sec), and good images were not obtained.

EXPERIMENT 4 (COMPARISON EXPERIMENT)

This was similar to the experiment 3, but the first developing device and the second developing device were exchanged. When the image was developed with the red toner by the second developing device, a slight amount of black toner of the first developing device was mixed into the red toner, because the first developing device contained black toner. The resultant image was not clear red, but was blackish.

As described in the foregoing, according to the embodiment of the present invention, the movement speed of the photosensitive drum 1 is changed in accordance with selection of the developing devices which are disposed at different distances from the primary charger. More particularly, when the first developer containing the chromatic color toner is selected, the rotational speed of the photosensitive drum is made smaller than when the second developing device containing the black toner is selected. Thus, the amounts of dark decay of the photosensitive drum 1 produced until the portion of the photosensitive drum reaches the first and second developing devices are made equivalent, whereby the dark portion potentials can be made substantially the same. As a result, the image formation can be performed with substantially the same charging current, so that a stabilized image contrast, and therefore, good image quality can be provided.

In addition, the inventors dare to reduce the rotational speed of the photosensitive drum when the first developing device is used, by which the nonmagnetic toner (chromatic toner such as red) can be prevented from scattering so that a stabilized contrast and image quality can be maintained for a long period of time.

Referring to FIGS. 3A and 3B, another embodiment of the present invention will be described. In the foregoing embodiment, the light information is applied to form the latent image after the uniform charging. In the present embodiment, the latent image is formed while the photosensitive member being charged.

As shown in FIG. 3B, a photosensitive member 15 comprises a transparent substrate 15*a* and made of glass or the like, a transparent electrode layer 15*c* (metal layer) and an amorphous silicon photosensitive layer 15*b*. The electrode layer 15*c* is electrically grounded. On the other hand, the information light is applied onto the drum 15 by an array 16 of LED elements in the drum 15 and through a short focus lens array 17, to expose the drum 15 to the image light. At the exposure position, a charger 2 is disposed adjacent to the outer surface of the drum to apply a uniform charge thereto. By the simultaneous application of the light and the charge, a latent image is formed on the surface of the drum.

In this apparatus, the time required from the latent image forming position to each of the developing devices is made substantially constant, by which the same advantageous effects as with the foregoing embodiment can be provided.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic process using a photosensitive member having an amorphous silicon photosensitive layer, comprising:

uniformly charging the photosensitive member;

exposing the charged photosensitive member to information light to form an electrostatic latent image; and developing the electrostatic latent image using a developing device selected from a plurality of developing devices disposed along a movement direction of the photosensitive member, wherein a movement speed of the photosensitive member is lower when the selected developing device is closer to a station where said uniform charging step is performed than when another developing device further from the charging station is selected, whereby time periods for a portion of the photosensitive member to move from the charging station to the developing devices are substantially the same.

2. A process according to claim 1, wherein one of the developing devices contains a black developer and another contains a chromatic developer.

3. A process according to claim 1, wherein said another developing device contains a red toner.

4. A process according to claim 1, wherein at least one of said developing devices contains a nonmagnetic toner.

5. An electrophotographic process using a photosensitive member having an amorphous silicon photosensitive layer, comprising:

charging the photosensitive member, and substantially simultaneously exposing the charged photosensitive member to information light to form an electrostatic latent image; and developing the electrostatic latent image using a developing device selected from a plurality of developing devices disposed along a movement direction of the photosensitive member, wherein a movement speed of the photosensitive member is lower when the selected developing device is closer to a station where said image forming step is performed than when another developing device further from the charging station is selected, whereby time periods for a portion of the photosensitive member to move from the charging station to the developing devices are substantially the same.

6. A process according to claim 5, wherein the electrostatic latent image is formed by substantially simultaneous application of uniform electric charge and information light to the photosensitive member.

7. A process according to claim 5, wherein one of the developing devices contains a black developer and another contains a chromatic developer.

8. A process according to claim 5, wherein said another developing device contains a red toner.

9. A process according to claim 7, wherein at least one of said developing devices contains a nonmagnetic toner.

10. An electrophotographic apparatus using a photosensitive member having an amorphous silicon photosensitive layer, comprising:

a charger for uniformly charging the photosensitive member;

optical means for exposing the charged photosensitive member to information light to form an electrostatic latent image;

plural developing devices, disposed along a movement direction of the photosensitive member, for selectively developing the latent images; and speed changing means for changing a movement speed of said photosensitive member so that the movement speed of the photosensitive member is lower when the selected one of the developing devices is closer to the charger than when another developing device further from the charger is selected, whereby the time periods for a portion of the photosensitive member to move from the charger to the developing devices are substantially the same.

11. An apparatus according to claim 10, wherein one of the developing devices contains a black developer and another contains a chromatic developer.

12. An apparatus according to claim 10, wherein said another developing device contains a red toner.

13. An apparatus according to claim 10, wherein at least one of said developing devices contains a nonmagnetic toner.

14. An electrophotographic apparatus using a photosensitive member having an amorphous silicon photosensitive layer, comprising:

image forming means for charging the photosensitive member and substantially simultaneously exposing the charged photosensitive member to information light to form an electrostatic latent image;

plural developing devices, disposed along a movement direction of the photosensitive member, for selectively developing the latent images; and speed changing means for changing a movement speed of said photosensitive member so that the movement speed of the photosensitive member is lower when a selected one of the developing devices is the one closer to the latent image forming means than when another developing device is selected, whereby time periods for a portion of the photosensitive member to move from the charger to the developing devices are substantially the same.

15. An electrophotographic process using a photosensitive member, comprising:

charging the photosensitive member and exposing the charged photosensitive member to information light to form an electrostatic latent image;

developing the electrostatic latent image using a developing device selected from a plurality of developing devices disposed along a movement direction of the photosensitive member, wherein a movement speed of the photosensitive member is lower when a selected developing device is closer to a station where said charging is performed than when another developing device further from the charging station is selected, whereby time periods for a portion of the photosensitive member to move from the charging station to the developing devices are substantially the same.

* * * * *

UNITED STATES PATENT AND TRADEMARK OFFICE

CERTIFICATE OF CORRECTION

PATENT NO. : 4,952,978

DATED : August 28, 1990

INVENTOR(S) : SHIGENORI UEDA, ET AL.

It is certified that error appears in the above-identified patent and that said Letters Patent is hereby corrected as shown below:

COLUMN 1

Line 14, "latent" (first occurrence) should be deleted.

COLUMN 3

Line 29, "moves" should read --move--.

Signed and Sealed this

Second Day of July, 1991

*Attest:*

*Attesting Officer*

HARRY F. MANBECK, JR.

*Commissioner of Patents and Trademarks*